US010479469B2

(12) United States Patent
Weber et al.

(10) Patent No.: US 10,479,469 B2
(45) Date of Patent: Nov. 19, 2019

(54) STEERING SYSTEM FOR AN OUTBOARD MOTOR

(71) Applicant: STEERING SOLUTIONS IP HOLDING CORPORATION, Saginaw, MI (US)

(72) Inventors: John E. Weber, Pinconning, MI (US); Christopher R. Douglas, Saginaw, MI (US); Andrew E. Maschke, Carolton, MI (US)

(73) Assignee: STEERING SOLUTIONS IP HOLDING CORPORATION, Saginaw, MI (US)

( * ) Notice: Subject to any disclaimer, the term of this patent is extended or adjusted under 35 U.S.C. 154(b) by 14 days.

(21) Appl. No.: 15/875,206

(22) Filed: Jan. 19, 2018

(65) Prior Publication Data

US 2018/0215454 A1 Aug. 2, 2018

Related U.S. Application Data

(60) Provisional application No. 62/451,208, filed on Jan. 27, 2017.

(51) Int. Cl.
*B63H 20/12* (2006.01)

(52) U.S. Cl.
CPC ..... *B63H 20/12* (2013.01); *B63B 2718/00* (2013.01); *B63B 2755/00* (2013.01)

(58) Field of Classification Search
CPC ..... B63H 20/12; B63H 20/16
See application file for complete search history.

(56) References Cited

U.S. PATENT DOCUMENTS 9,511,839 B2 * 12/2016 Morikami ..... B63H 25/42
2010/0167604 A1 * 7/2010 Inaba ..... B63H 20/12 440/60

* cited by examiner

*Primary Examiner* — Andrew Polay

(57) ABSTRACT

A steering system includes a steering sensor, a gear motor assembly, and a controller. The steering sensor is disposed at a helm. The gear motor assembly at least partially extends between a mid-unit and a lower unit of an outboard motor. The controller is in communication with the steering sensor and the gear motor assembly. The controller is programmed to command the gear motor assembly to pivot the lower unit relative to the mid-unit in response to a signal provided by the steering sensor.

6 Claims, 2 Drawing Sheets

STEERING SYSTEM FOR AN OUTBOARD MOTOR

CROSS-REFERENCES TO RELATED APPLICATIONS

This patent application claims priority to U.S. Provisional Patent Application Ser. No. 62/451,208, filed Jan. 27, 2017 which is incorporated herein by reference in its entirety.

BACKGROUND

Marine vessels may include an outboard motor that may be pivotally connected to the marine vessel. The entire outboard motor may be movable relative to the marine vessel to steer the marine vessel by a steering system may be a mechanical non-power assist steering system or a hydraulic power assist steering system. Under low speeds such as a docking maneuver, the operator of the marine vessel may need to rapidly rotate the wheel through large degrees of rotation without assist that may be fatiguing to the operator of the vehicle.

SUMMARY

According to an embodiment of the present disclosure, a steering system for an outboard motor. The steering system includes a steering sensor, a gear motor assembly, and a controller. The steering sensor is disposed at a helm. The gear motor assembly at least partially extends between a mid-unit and a lower unit of an outboard motor. The controller is in communication with the steering sensor and the gear motor assembly. The controller is programmed to command the gear motor assembly to pivot the lower unit relative to the mid-unit in response to a signal provided by the steering sensor.

According to another embodiment of the present disclosure, a steering system for a marine vessel is provided. The steering system includes a lower unit and a gear motor assembly. The lower unit has a propeller that is drivably connected to a drive shaft that extends through a mid-unit of an outboard motor. The gear motor assembly includes an electric motor that is disposed within the mid-unit, a drive gear drivably connected to the electric motor, and a driven gear disposed on a top surface of the lower unit. The lower unit being arranged to pivot the lower unit relative to the mid-unit about the drive shaft.

According to yet another embodiment of the present disclosure, a steering system for a marine vessel is provided. The steering system includes a steering sensor, an outboard motor, and a gear motor assembly. The steering sensor is arranged to provide a signal indicative of an angular position of a steering wheel. The outboard motor includes an upper unit that receives an engine having a drive shaft, a mid-unit that extends from the upper unit, and a lower unit. The drive shaft extends through the mid-unit and into the lower unit. The gear motor assembly is at least partially integrated within the outboard motor and is arranged to pivot the lower unit relative to the mid-unit about the drive shaft.

These and other advantages and features will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the present disclosure will be described with reference to specific embodiments, without limiting same, it is to be understood that the disclosed embodiments are merely illustrative examples of the present disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
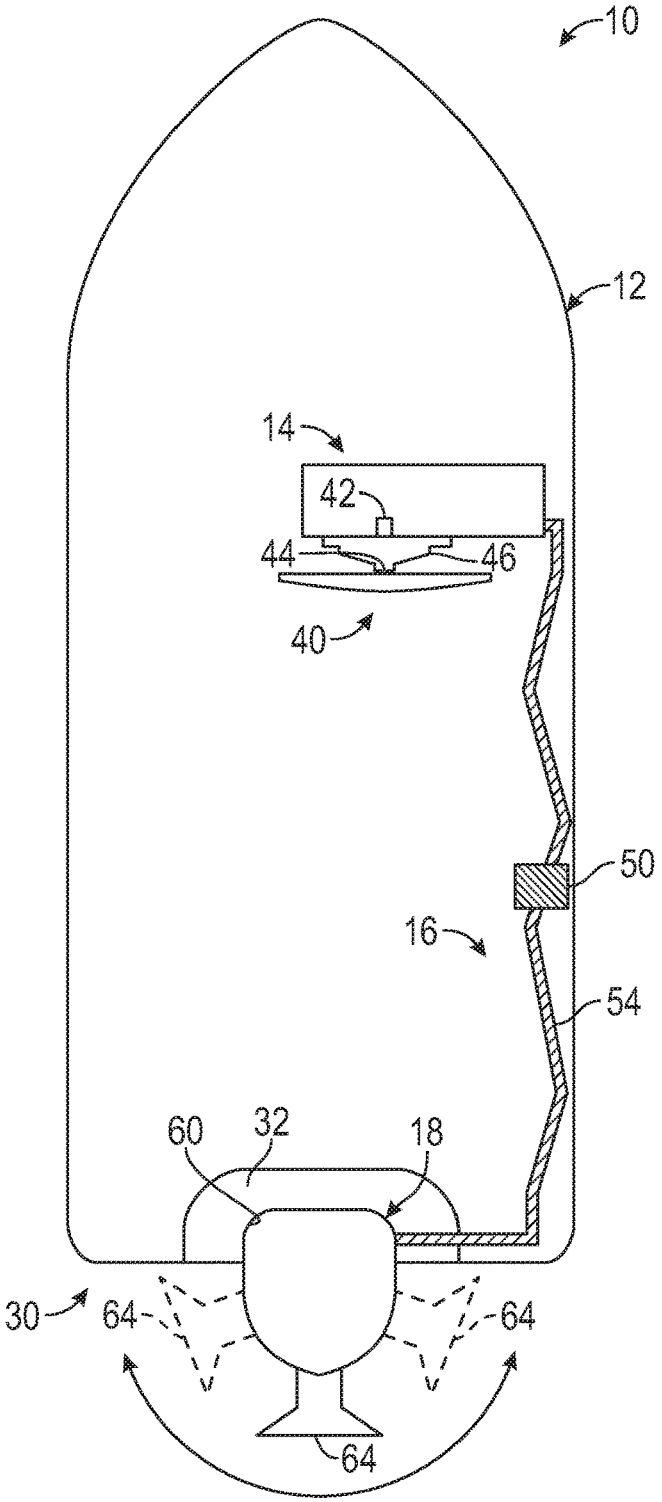
FIG. 1 is a schematic view of a marine vessel.

Referring to FIG. 1, a watercraft or a marine vessel 10 is shown. The marine vessel 10 includes a hull 12, a helm 14, a steering system 16, and an outboard motor 18.

The body or hull 12 includes a transom 30 that extends across an aft portion of the hull 12. The outboard motor 18 is attached to a portion of the transom 30 or another region of the aft portion of the hull 12 and at least partially extends into a transom well 32.

Some marine vessels are provided with a steering system that includes a cable or hydraulic cylinder/pump/hose apparatus. Generally the hydraulic cylinder is attached in front of the outboard motor and through a tilt tube. At the helm of the marine vessel there may be a manually operated pump mounted behind a steering wheel. The manually operated pump and the hydraulic cylinder are fluidly connected to the hydraulic hoses that provide a pressurized fluid to one side or the other of the hydraulic cylinder by the rotation or turning of the steering wheel to turn or pivot the entire outboard motor about a pivot point to direct the thrust of a propeller of the outboard motor to turn the marine vessel. Such a steering system may consume copious amounts of open space of the marine vessel leading to the transom well to be fairly large to permit for angulation of the outboard motor. Furthermore, installation difficulties for the hydraulic system may be present as well as environmental concerns such as potential leaks from the hydraulic system. The steering system 16 is provided to simplify cable or hydraulic cylinder/pump/hose apparatus steering systems as well as providing greater angulation of the outboard motor 18 as well as to provide a more efficient and environmentally friendly steering system.

The helm 14 is spaced apart from the transom 30 and the outboard motor 18. The helm 14 is provided with a steering device or a steering wheel 40 and a steering sensor 42. The steering wheel 40 is connected to a steering shaft 44 that extends into a steering column 46. An operator of the marine vessel 10 is able to provide a steering input into the steering wheel 40 such that the steering shaft 44 and the steering wheel 40 rotated about a steering column axis. The steering sensor 42 is arranged or positioned to provide a signal indicative of a rotational position of the steering wheel 40 and/or the steering shaft 44, an angular position of the steering wheel 40 and/or the steering shaft 44, or a torque and a direction of rotation of the steering wheel 40 and/or the steering shaft 44.

The steering sensor 42 may be disposed at the helm 14 while being provided as part of the steering system 16 that is operatively connected to the helm 14 and at least a portion of the outboard motor 18.

The steering system 16 may be an electric power steering system that includes the steering sensor 42, a controller 50, and a gear motor assembly 52.

The controller 50 may be disposed in the hull 12 (as shown in FIG. 1), disposed proximate the outboard motor 18, integrated into the helm 14, or integrated into the outboard motor 18. The controller 50 is in communication with the steering sensor 42 and the gear motor assembly 52 through a communication line 54 that extends between steering sensor 42 and the controller 50 and the controller 50 and the outboard motor 18 and/or the gear motor assembly 52. The communication line 54 may provide power to and communication between the steering sensor 42, the controller 50, and the gear motor assembly 52.

The controller 50 is provided with input communication channels that are arranged to receive the signal from the steering sensor 42 and in some embodiments a signal from a position sensor that is disposed on or within the outboard motor 18 that is arranged to provide a signal indicative of a position of at least a portion of the outboard motor 18. The controller 50 is provided with output communication channels that are arranged to provide signals or commands to the gear motor assembly 52 to pivot or turn at least a portion of the outboard motor 18. The controller 50 includes at least one processor that is programmed to provide the signals or commands to the gear motor assembly 52 to at least pivot or turn at least a portion of the outboard motor 18 in response to the signal provided by the steering sensor 42 while or when the steering wheel 40 is rotated or operated.

The gear motor assembly 52 is at least partially integrated within the outboard motor 18. The gear motor assembly 52 is arranged to pivot or turn a portion of the outboard motor 18 and not the entire outboard motor 18 relative to the transom 30 of the marine vessel 10 to steer or turn the marine vessel 10.

Figure 2:
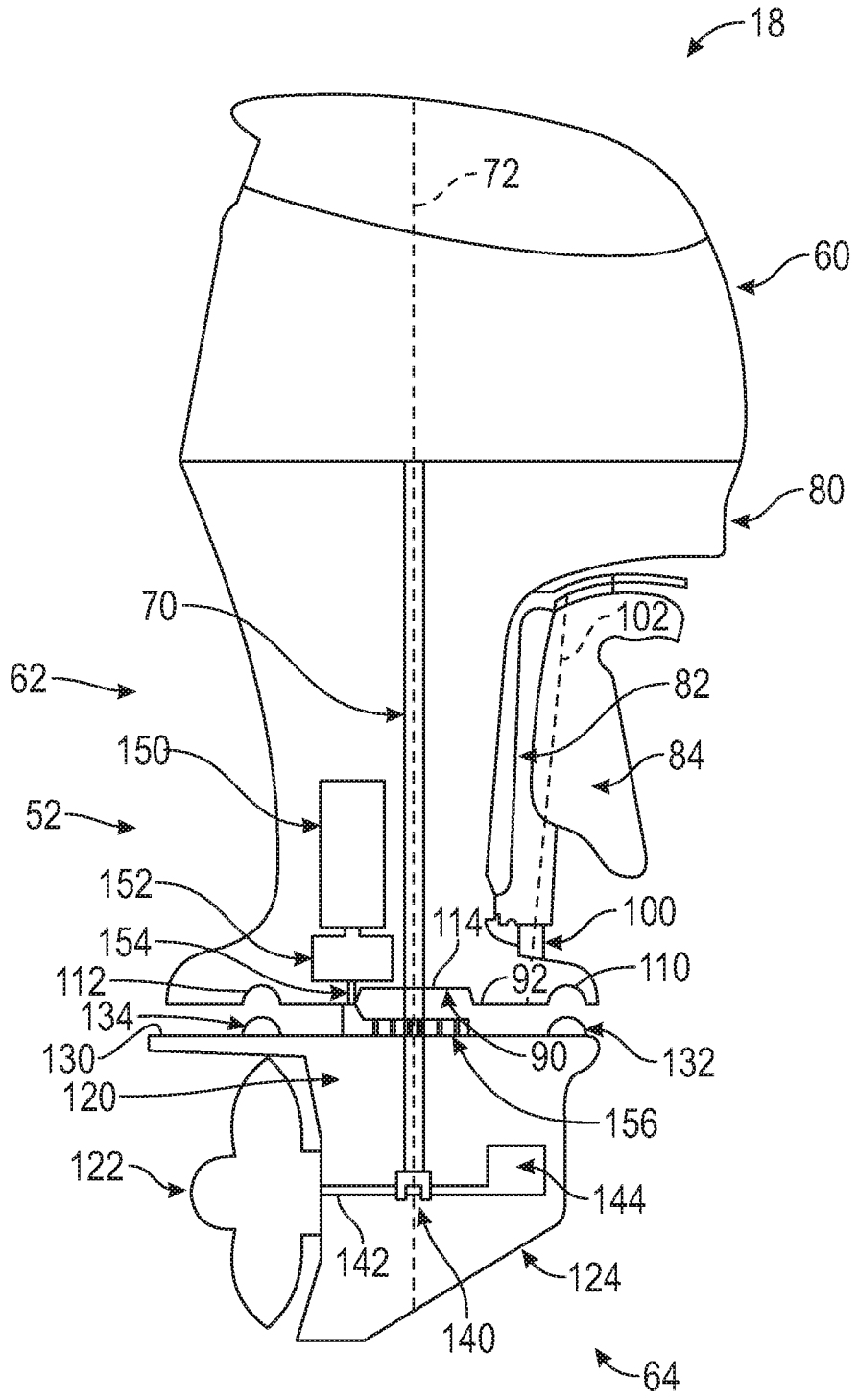
FIG. 2 is a side view of an outboard motor of the marine vessel.

Referring to FIG. 2, the outboard motor 18 includes an upper unit 60, a mid-unit 62, and a lower unit 64.

A powerhead or engine is at least partially received within the upper unit 60. The powerhead or engine has a drive shaft 70 that extends from the upper unit 60 through the mid-unit 62 and extends into the lower unit 64 along a drive shaft axis 72. The drive shaft axis 72 may be a vertical or generally vertical axis.

The mid-unit 62 extends from and is operatively connected to the upper unit 60. The mid-unit 62 extends between the upper unit 60 and the lower unit 64. The mid-unit 62 includes a first housing 80, a second housing 82, and a mounting bracket 84.

The first housing 80 may be integrally formed or fixedly attached to the upper unit 60. The first housing 80 is configured as a hollow body through which the drive shaft 70 extends and at least a portion of the gear motor assembly 52 is received. The first housing 80 includes a cutout or a recessed region 90 and a floor 92.

The cutout or recessed region 90 is configured to at least partially receive the second housing 82 and the mounting bracket 84. The second housing 82 is connected to the first housing 80 by a rod such as a pivot rod 100. The pivot rod 100 at least partially defines a pivot axis 102 about which the entire outboard motor 18 may be pivoted. The pivot axis 102 may be disposed generally parallel to the drive shaft axis 72.

The mounting bracket 84 is connected to and extends from at least one of the second housing 82 and the pivot rod 100. The mounting bracket 84 is configured to connect the outboard motor 18 to the transom 30 or another portion of the marine vessel 10. The mounting bracket 84 enables the entire outboard motor 18 to be trimmed or tilted relative to the transom 12 of the marine vessel 10.

The floor 92 of the first housing 80 faces towards the lower unit 64. The floor 92 defines a first sealing recess 110, a second sealing recess 112, and a central recess 114. The first sealing recess 110 extends from the floor 92 of the first housing 80 towards the upper unit 60. The second sealing recess 112 is spaced apart from the first sealing recess 110. The second sealing recess 112 extends from the floor 92 of the first housing 80 towards the upper unit 60. At least one of the first sealing recess 110 and/or the second sealing recess 112 may define a first sealing member. In at least one embodiment, the first sealing recess 110 and the second sealing recess 112 are part of a sealing recess that extends about the floor 92 of the first housing 80 of the mid-unit 62.

The central recess 114 is disposed between the first sealing recess 110 and the second sealing recess 112. The central recess 114 is at least partially disposed about the drive shaft axis 72. The central recess 114 extends from the floor 92 towards the upper unit 60. The central recess 114 is sized to at least partially receive a portion of a gear member of the gear motor assembly 52.

The drive shaft 70 extends through the first housing 80 of the mid-unit 62 and through the floor 92 and the central recess 114 of the first housing 80 and extends into the lower unit 64.

The lower unit 64 is spaced apart from the mid-unit such that the lower unit 64 is arranged to pivot relative to the upper unit 60 and the mid-unit 62 about the drive shaft 70 having the drive shaft axis 72 responsive to operation of the gear motor assembly 52 to steer the marine vessel 10. The lower unit 64 is arranged to pivot or rotate about the drive shaft 70 having the drive shaft axis 72 such that the upper unit 60 having the powerhead does not turn, pivot or rotate. The rotation of pivoting of the lower unit 64 simplifies the tilt/turning mechanism for the marine vessel 10 and moves the powerhead/weight forward onto the transom 50, allowing for increased angulation of the lower unit 64 and skeg. The increased angulation improves handling of the marine vessel 10, especially at lower vessel speeds to improve docking and other low speed maneuvers.

The lower unit 64 includes a third housing 120, a propeller 122, and a skeg 124. In at least one embodiment, the lower unit 64 or the entire outboard motor 18 may be provided as part of the steering system 16.

The third housing 120 is configured as a hollow body having a top surface 130 that faces towards and is at least partially spaced apart from the floor 92 of the first housing 80 of the mid-unit 62. The top surface 130 defines a first protrusion 132 and a second protrusion 134. The first protrusion 132 extends from the top surface 130 towards the floor 92 and may be at least partially received within the first sealing recess 110. The second protrusion 134 is spaced apart from the first protrusion 132. The second protrusion 134 extends from the top surface 130 towards the floor 92 may be at least partially received within the second sealing recess 112. In at least one embodiment, at least one of the first protrusion 132 and the second protrusion 134 define a sealing member that extends about the top surface 130 or an upper portion of the third housing 120 of the lower unit 64.

At least one of the first protrusion 132 and the second protrusion 134 may define a second sealing member that is configured to engage or be received by the first sealing member. The first sealing member and the second sealing member are configured as rotary seals that are defined or disposed between the lower unit 64 and the mid-unit 62 to provide waterproofing between the lower unit 64 and the mid-unit 62 to at least partially seal the gear motor assembly 52.

The propeller 122 is drivably connected to the drive shaft 70 through a gear assembly 140 and a propeller shaft 142 that are disposed within the third housing 120. The gear assembly 140 is operatively connected to the propeller shaft 142 and the drive shaft 70. The gear assembly 140 may be configured as a transmission, a bevel gear, or the like that controls the direction of rotation of the propeller 122 to control the forward and reverse operation of the marine vessel 10. An actuator 144 may be disposed within the third housing 120 and may be in communication with the controller 50 and the gear assembly 140. The actuator 144 is arranged to or configured to shift the propeller 122 between forward operation and reverse operation by actuating the gear assembly 140.

The skeg 124 is operatively connected to the third housing 120. The skeg 124 is disposed opposite the top surface 130 of the third housing 120.

The gear motor assembly 52 is at least partially disposed within or at least partially extends between the first housing 80 of the mid-unit 62 and/or the third housing 120 of the lower unit 64. In the embodiment shown, the gear motor assembly 52 is at least partially disposed within the first housing 80 of the mid-unit 62 and is at least partially disposed on the third housing 120 of the lower unit 64.

The gear motor assembly 52 is in communication with the steering sensor 42, the controller 50, and the steering wheel 40. The gear motor assembly 52 includes an electric motor 150, a gearbox 152, a drive gear 154, and a driven gear 156.

The electric motor 150 is disposed within the first housing 80 of the mid-unit 62. The electric motor 150 is drivably connected to the gearbox 152 that is disposed within the first housing 80 of the mid-unit 62. The drive gear 154 may be drivably connected to the electric motor 150 through the gearbox 152. The drive gear 154 may be provided as part of the gearbox 152 such that the drive gear 154 extends from the gearbox 152 towards the driven gear 156. The drive gear 154 extends through the floor 92 of the first housing 80 of the mid-unit 62. The drive gear 154 is drivably connected to the driven gear 156. The drive gear 154 may be a pinion gear that is in meshed engagement with the driven gear 156.

The driven gear 156 is connected to the third housing 120 of the lower unit 64. The driven gear 156 is arranged to pivot the third housing 120 and ultimately the lower unit 64 relative to the mid-unit 62 about the drive shaft axis 72 responsive to rotation of the drive gear 154. In at least one embodiment, the driven gear 156 includes an extension that extends towards and is operatively connected to the drive gear 154. The driven gear 156 is disposed on the top surface 130 of the third housing 120 and is disposed about the drive shaft 70. The driven gear 156 is disposed between the first protrusion 132 and the second protrusion 134 such that the driven gear 156 is circumscribed by the second sealing member. The driven gear 156 may be a ring gear that is centered about the drive shaft 70. Other locations of the driven gear 156 that may pivot the lower unit 64 are also contemplated. The driven gear 156 is at least partially received within the central recess 114 defined by the floor 92 of the first housing 80 of mid-unit 62.

The first sealing member and the second sealing member are arranged to provide at least some level of waterproofing for the driven gear 156.

As stated previously, the steering wheel 40 and/or the steering sensor 42, the controller 50, and the gear motor assembly 52 are all in communication with each other through communication lines 54, as shown in FIG. 1. The communication lines 54 are configured to provide power to and transfer data or signals between the steering sensor 42, the controller 50, and the gear motor assembly 52. As an operator of the marine vessel 10 turns the steering wheel 40, the steering sensor 42 provides a signal indicative of rotation or an angular position of the steering wheel 40 to the controller 50. The controller 50 may command or send power to the gear motor assembly 52 such that the drive gear 154 pivots or rotates the driven gear 156. The pivoting or rotating of the driven gear 156 by the drive gear 154 causes the lower unit 64 to pivot relative to the mid-unit 62 and the upper unit 60 about the drive shaft axis 72 to direct thrust of the propeller 122 to turn the marine vessel 10.

The arrangement of the steering system 16 for the marine vessel 10 or the outboard motor 18 of the present disclosure having the driven gear 156 centered about the drive shaft 70 allows for higher angulation of at least a portion of the outboard motor 18 to allow better steering or maneuverability of the marine vessel 10. Furthermore, the arrangement of the steering system 16 of the present disclosure provides a smooth steering force from lock to lock as well as provides a tunable steering feel or function without feedback be provided to the helm 14 due to the implementation of the electric power steering components. Additionally, the steering system 16 is a simplified, compact steer by wire system having fewer mechanical connections without fluids to leak and having low energy usage.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description.

Having thus described the invention, it is claimed:

1. A steering system for a marine vessel, comprising:

a lower unit having a propeller that is drivably connected to a drive shaft that extends through a mid-unit of an outboard motor; and a gear motor assembly, comprising:

an electric motor that is disposed within the mid-unit, a drive gear drivably connected to the electric motor, and a driven gear disposed on a top surface of the lower unit, the lower unit being arranged to pivot the lower unit relative to the mid-unit about the drive shaft to steer a marine vessel, the top surface defining a first protrusion and a second protrusion, the driven gear disposed between the first protrusion and the second protrusion.

2. The steering system of claim 1, wherein at least one of the first protrusion and the second protrusion define a sealing member that extends about the top surface.

3. A steering system for a marine vessel, comprising:

a steering sensor arranged to provide a signal indicative of an angular position of a steering wheel;

an outboard motor including an upper unit that receives an engine having a drive shaft, a mid-unit that extends from the upper unit, and a lower unit, the drive shaft extending through the mid-unit and into the lower unit;

a gear motor assembly at least partially integrated within the outboard motor and being arranged to pivot the lower unit relative to the mid-unit about the drive shaft to steer a marine vessel, wherein the gear motor assembly at least partially extends between the mid-unit and the lower unit, wherein the mid-unit has a floor that faces towards the lower unit, wherein the lower unit has a top surface that faces towards the upper unit, the top surface defining a first protrusion and a second protrusion; and a driven gear disposed between the first protrusion and the second protrusion.

4. The steering system of claim 3, further comprising: a controller programmed to, in response to the signal, command the gear motor assembly to operate to pivot the lower unit relative to the mid-unit about the drive shaft.

5. The steering system of claim 3, wherein the gear motor assembly, includes:

an electric motor disposed within the mid-unit, and a drive gear drivably connected to the electric motor that extends through the floor.

6. The steering system of claim 3, wherein the driven gear is disposed about the drive shaft.

* * * * *